US005437597A

United States Patent [19]

Boughton et al.

[11] Patent Number: 5,437,597

[45] Date of Patent: Aug. 1, 1995

[54] DOCUMENT INVERTER FOR BUCKLE CHUTE FOLDER

[75] Inventors: Richard D. Boughton, Newton; Carlos L. DeFigueiredo, Sandy Hook; Helen Rose, Seymour, all of Conn.

[73] Assignee: Pitney Bowes Inc., Stamford, Conn.

[21] Appl. No.: 257,976

[22] Filed: Jun. 10, 1994

[51] Int. Cl.[6] ..... B65H 45/14

[52] U.S. Cl. ..... 493/420; 493/421

[58] Field of Search ..... 493/420, 421

[56] References Cited

U.S. PATENT DOCUMENTS 3,211,448 10/1965 Stoothoff ..... 493/421

5,180,357 1/1993 Marzullo ..... 493/421

FOREIGN PATENT DOCUMENTS 704592 2/1931 France ..... 493/421

2069981 9/1981 United Kingdom ..... 493/421

*Primary Examiner*—Jack W. Lavinder

*Attorney, Agent, or Firm*—Charles R. Malandra, Jr.; Melvin J. Scolnick

[57] ABSTRACT

A buckle chute for folding a sheet of paper. The buckle chute includes: a first plate having a vertically extending slot; a second plate opposing the first plate and defining a paper path therewith; a paper stopping tab extending through the vertically extending slot; a paper inverting tab extending through the vertically extending slot and situated above the paper stopping tab, the inverting tab being pivotable between an operative position in the paper path and an inoperative position out of the paper path; and a lever operatively connected to the paper inverting tab and extending beyond the side edge of the first plate for pivoting the tab between the operative and inoperative positions.

4 Claims, 5 Drawing Sheets

DOCUMENT INVERTER FOR BUCKLE CHUTE FOLDER

BACKGROUND OF THE INVENTION

The instant invention relates to buckle chute folders for folding sheets of paper, and more particularly to apparatus for inverting documents within the buckle chute.

Buckle chute paper folders employing folding rollers are well known. A sheet of paper is fed by a first pair of feed rollers into a buckle chute, which stops the forward progress of the paper sheet and causes a buckle to be formed. The buckle is then forced to enter the nip of a pair of folding rollers (one of which may be one of the feed rollers) which impart a crease in the buckle. The folding rollers then continue to feed the folded sheet toward a pair of exit rollers or another buckle chute for forming a second fold or inverting the document so that the top surface becomes the bottom surface and vice versa.

In those situations where it is desired to invert the document, the second buckle chute requires a modification so that the folded document is not folded a second time but rather is simply allowed to enter and then exit the buckle chute. In prior art buckle chute folders, the modification is effected by removing the buckle chute from the folding apparatus, and either replacing the folding buckle chute with an inverting buckle chute, or moving levers in the buckle chute so that its function is changed. The operator then either installs the replacement buckle chute or re-installs the modified, original buckle chute. In either case, the process is cumbersome and could not be described as user-friendly.

The instant invention obviates the foregoing problem of having to remove the buckle chute to change it from a folding format to an inverting format by providing a buckle chute with inverting apparatus that can be changed from the folding format to the inverting format without removing the buckle chute from the folding apparatus.

SUMMARY OF THE INVENTION

Accordingly, the instant invention provides a buckle chute for folding a sheet of paper. The buckle chute includes: a first plate having a vertically extending slot; a second plate opposing the first plate and defining a paper path therewith; a paper stopping tab extending through the vertically extending slot; a paper inverting tab extending through the vertically extending slot and situated above the paper stopping tab, the inverting tab being pivotable between an operative position in the paper path and an inoperative position out of said paper path; and a lever operatively connected to the paper inverting tab and extending beyond the side edge of the first plate for pivoting the tab between the operative and inoperative positions.

DETAILED DESCRIPTION OF THE PREFERRED EMBODIMENT

Figure 1:
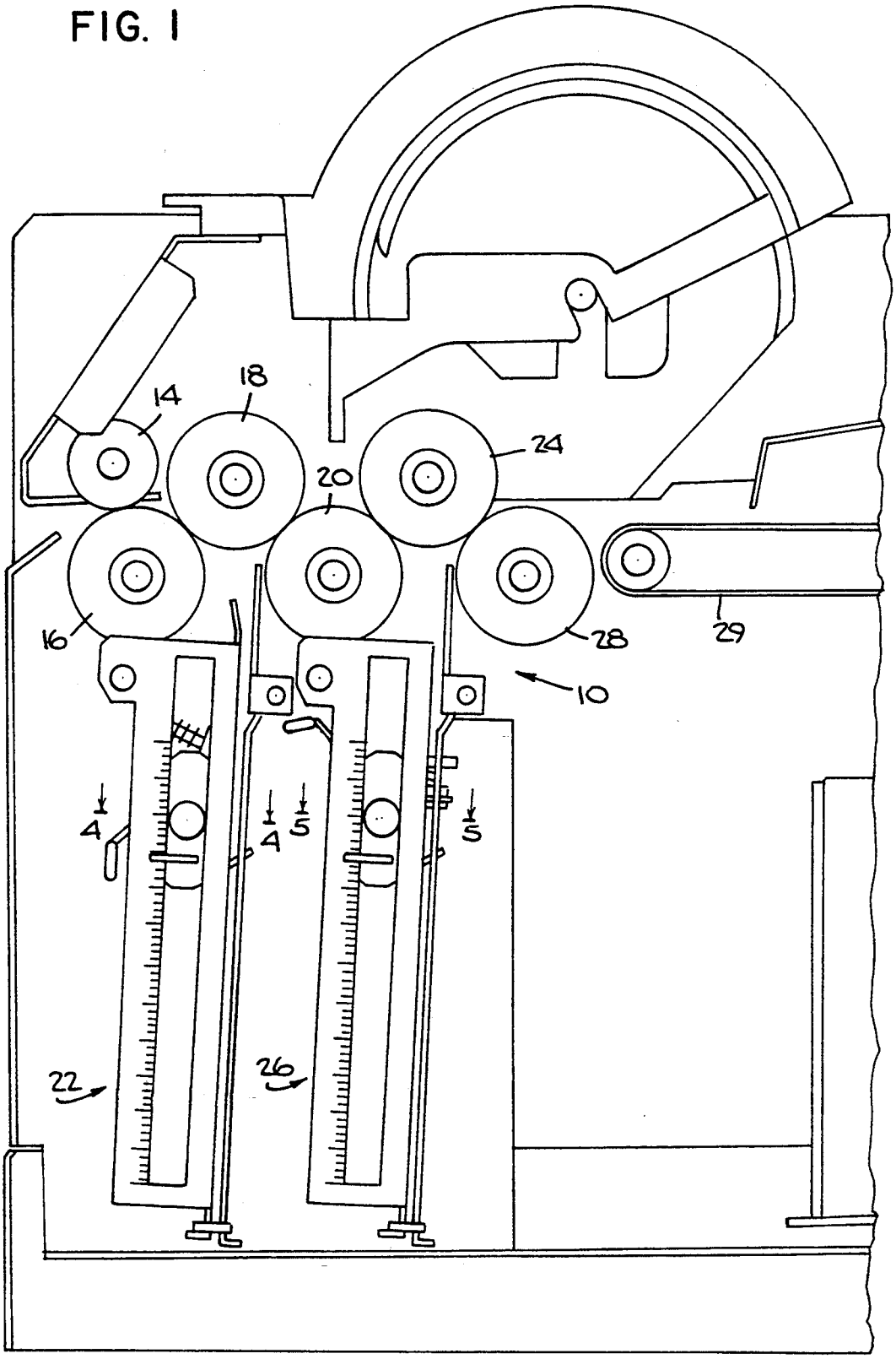
FIG. 1 is a side, elevational view of a pair of buckle chute folders in accordance with the instant invention, the left buckle chute being seen in the folding position and the right buckle chute being seen in the inverting position.

In describing the preferred embodiment of the instant invention, reference is made to the drawings, wherein there is seen in FIG. 1 buckle chute folding apparatus generally designated 10 capable of imparting two successive folds to a single sheet of paper 12 or a collation of several sheets of paper. Alternatively, the folding apparatus 10 can be used to invert a sheet of paper and then impart a single fold, or impart a single fold and then invert the paper, as discussed in detail hereinbelow. The sheets of paper 12 are fed from paper handling devices (not shown) located upstream of the folding apparatus 10, such as feeders and collators, to a first feed roller 14 and a second feed roller 16. Associated with the second feed roller 16 is a first folding roller 18 and together they function as a pair of feeding rollers. A second folding roller 20 is associated with the first folding roller 18. Downstream of the folding rollers 16 and 18 is a first buckle chute 22.

Associated with the second folding roller 20 is a third folding roller 24, downstream of which is a second buckle chute 26. Associated with the third folding roller 24 is a fourth folding roller 27. The folding rollers 20 and 24 cooperate to function as a pair of feeding rollers as will be explained further hereinbelow. Downstream of the folding rollers 24 and 27 is a conveyor belt 29 for further transporting the folded sheets of paper 12.

Figure 3:
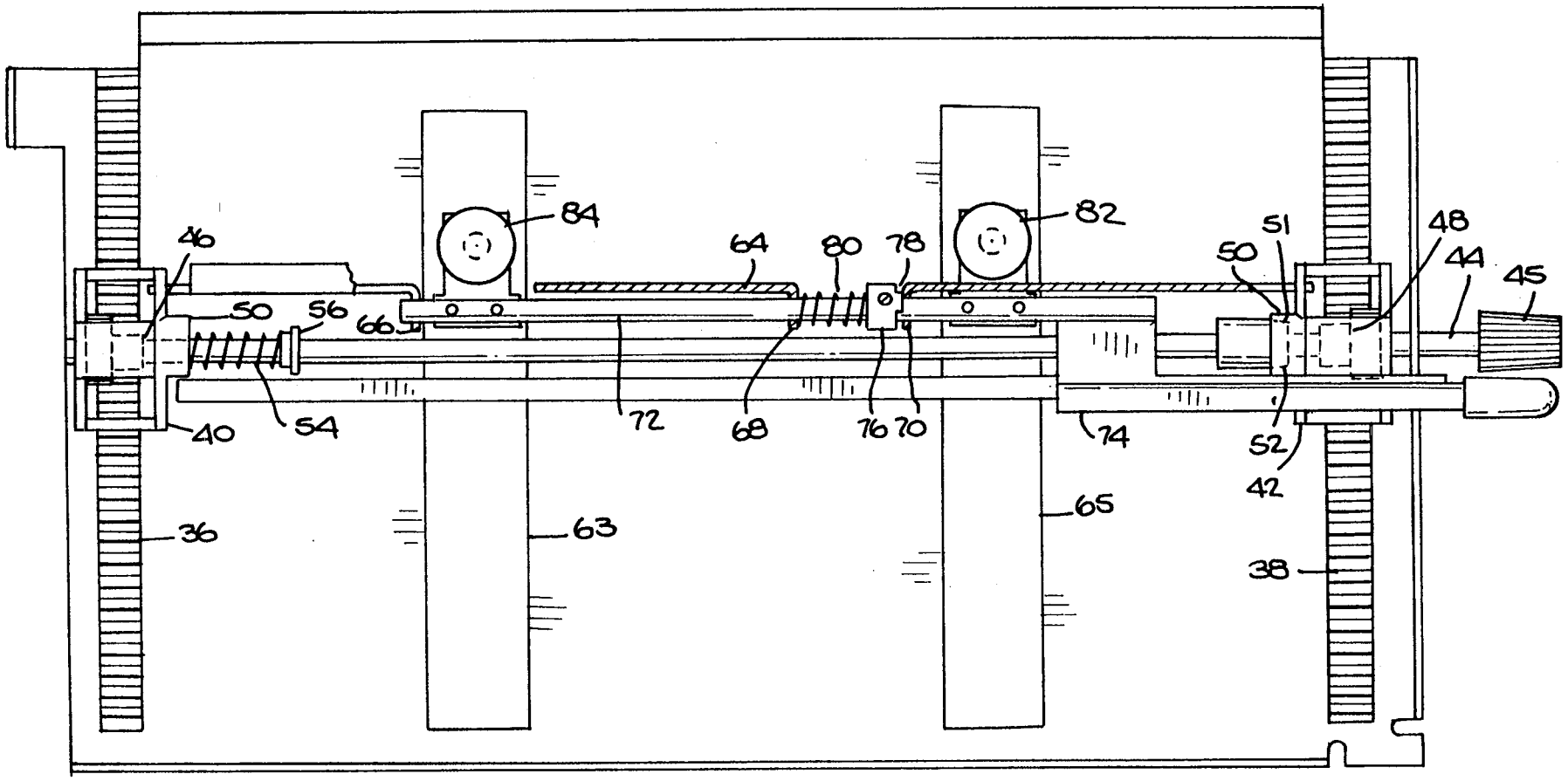
FIG. 3 is a rear, elevational view of the buckle chute seen in FIG. 2.

In describing the buckle chutes 22 and 26, reference will be made to the first buckle chute 22, but since the buckle chutes 22 and 26 are identical, the description of the first buckle chute 22 will apply equally as well to the second buckle chute 26. The buckle chute 22 consists of a first plate 28 and an opposing plate 30. The first plate 28 includes a perpendicular flange 32 having a longitudinally extending channel 34. Located at the ends of the first plate 28 are a pair of racks 36 and 38 (see FIG. 3). Riding between the first plate 28 and the racks 36 and 38 are a pair of carriages 40 and 42 respectively. A shaft 44 with a knob 45 extends through the channel 34 and beyond the flange 32 and is rotatably and slidably mounted in the carriages 40 and 42. At the ends of the shaft 44 a pair of pinions 46 and 48 are fixedly mounted on the shaft 44 and engage the racks 36 and 38 respectively. Each carriage 40 and 42 includes a donut-shaped flange 50 having gear teeth 51 on the interior surface thereof. A conical gear 52 is fixedly secured at one end of the shaft 44 and slidingly engages the gear teeth 51. A compression spring 54 is wrapped around the shaft 44 adjacent the carriage 40 and seats in the flange 50 of the carriage 40. A ring 56 is secured to the shaft 44 and holds the spring 54 in place. The spring 54 functions to bias the conical gear 52 into locking engagement with the gear teeth 51.

Figure 4:
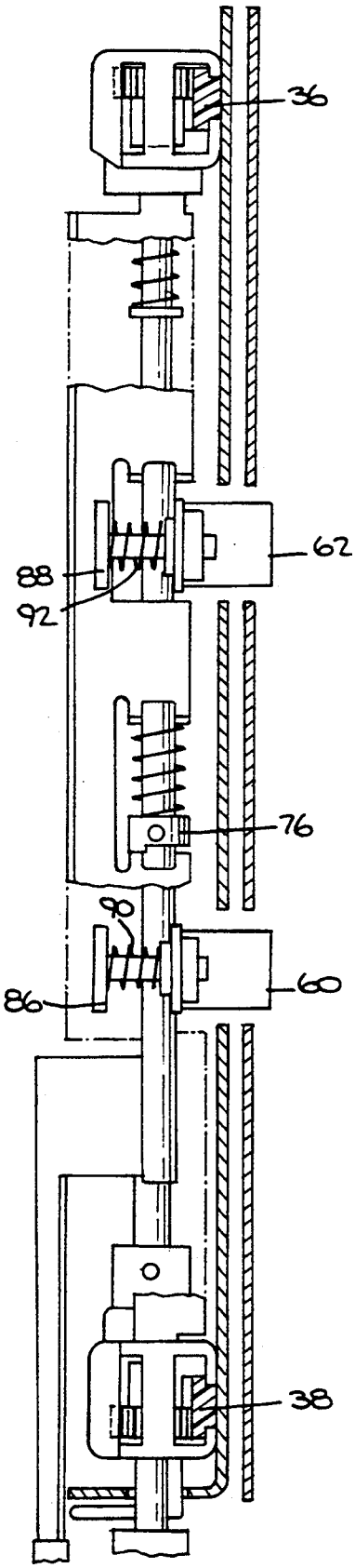
FIG. 4 is a sectional view taken on the plane indicated by the line 4—4 in FIG. 1.

A beam 58 is secured at its ends to the lower portions of the carriages 40 and 42. A pair of tabs 60 and 62 project from the beam 58 (see FIGS. 3 and 4) through a pair of slots 63 and 65 in the first plate 28 and function as stops for the paper sheets entering the buckle chute 22 when the buckle chute 22 is functioning in its folding mode, to be discussed in further detail hereinbelow.

Figure 5:
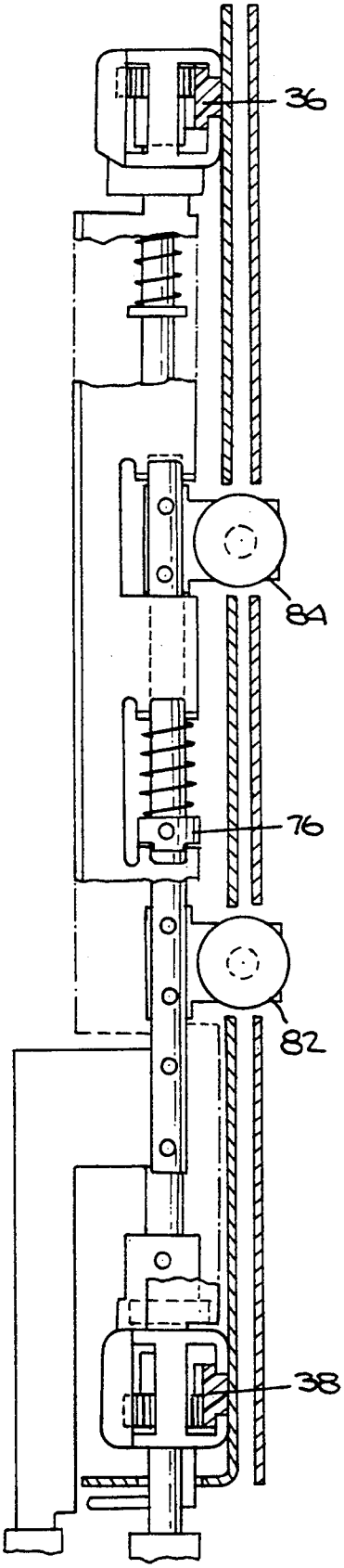
FIG. 5 is a sectional view taken on the plane indicated by the line 5—5 in FIG. 1.

Secured to the top portion of the carriages 40 and 42 is a joist 64 having slotted flaps 66, 68 and 70 for receiving a second shaft 72 having a lever 74 extending beyond the plate flange 32 which enables an operator to rotate the shaft 72, to be explained in further detail hereinbelow. A locking collar 76 having a camming surface 78 for engagement with the slotted flap 70 is biased against the flap 70 by a spring 80 seated on the shaft 72 between the collar 76 and the flap 68. Secured to the shaft 72 are a second pair of tabs 82 and 84 (see FIG. 5). Each of the tabs 82 and 84 has an aperture for receiving a plunger 86 and 88 respectively (see FIG. 4). A pair of compression springs 90 and 92 bias the plungers 86 and 88 respectfully away from the top of the tabs 82 and 84 respectively. The plungers 86 and 88 function to invert paper entering the buckle chute 22, as explained more fully hereinbelow.

Figure 2:
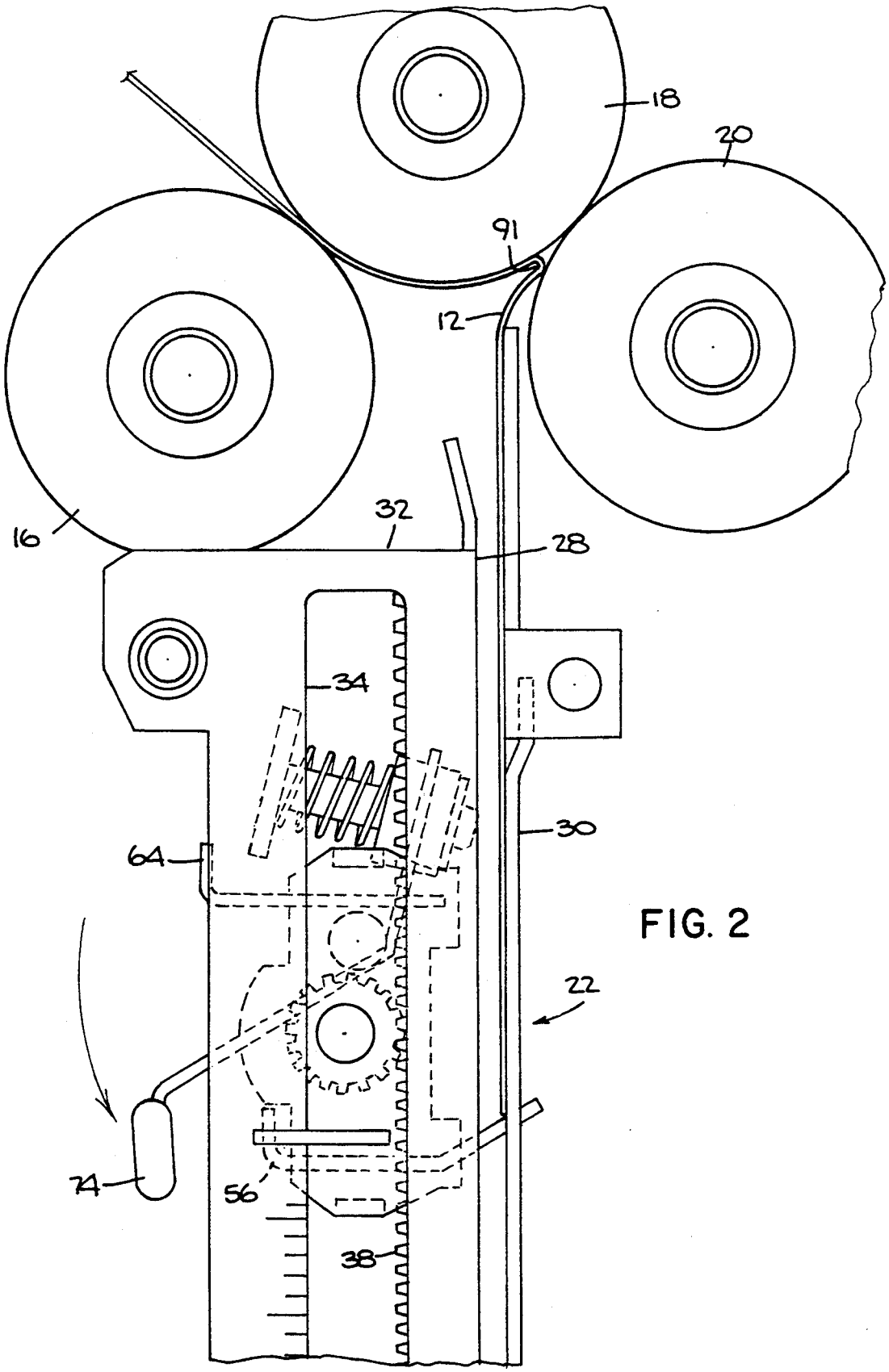
FIG. 2 is an enlarged, side, elevational view of the left buckle chute seen in FIG. 1.

The operation of the buckle chutes 22 and 26 will now be discussed. Referring now to FIG. 2, the buckle chute 22 is shown with the plungers 86 and 88 rotated by the lever 74 behind the first plate 28. This position of the plungers 86 and 88 allows paper entering the chute 22 to reach the stopping tabs 60 and 62 which allows the buckle chute 22 to function in its regular, folding mode, as is well know in the art. When it is desired to operate the second chute 26 in the inverting mode, so that, for example, the address on the document will be in the correct location for insertion into a windowed envelope (not shown), the lever 74 is rotated clockwise (FIG. 2) until the collar 76 is forced into locking engagement with the slotted flap 70. This rotation of the lever 74 also rotates the tabs 82 and 84 and their associated, spring-biased plungers 86 and 88 respectively clockwise to the positions seen in FIG. 6 so that the plungers 86 and 88 are positioned in the paper path of the buckle chute 26. When it is desired to move the plungers 86 and 88 out of the paper path of the buckle chute 26, to the position shown in FIG. 2 for the buckle chute 22, the operator merely pushes the lever 74 inward to release the camming surface 78 from engagement with the slotted flap 70 and rotates the lever 74 counterclockwise until the lever 74 abuts the plate flange 32.

The size of the paper being processed determines where the carriages 40 and 42 are situated on the racks 36 and 38, which in turn determines the location of the plungers 86 and 88 and the stopping tabs 60 and 62. When the operator desires to change the location of the carriages 40 and 42, it is only necessary that he push the knob 45 inward to release the conical gear 52 from engagement with the gear teeth 51, and then rotate the knob 45 to rotate the pinions 46 and 48 and thereby move the carriages 40 and 42 on the racks 36 and 38 either upward or downward.

Figure 6:
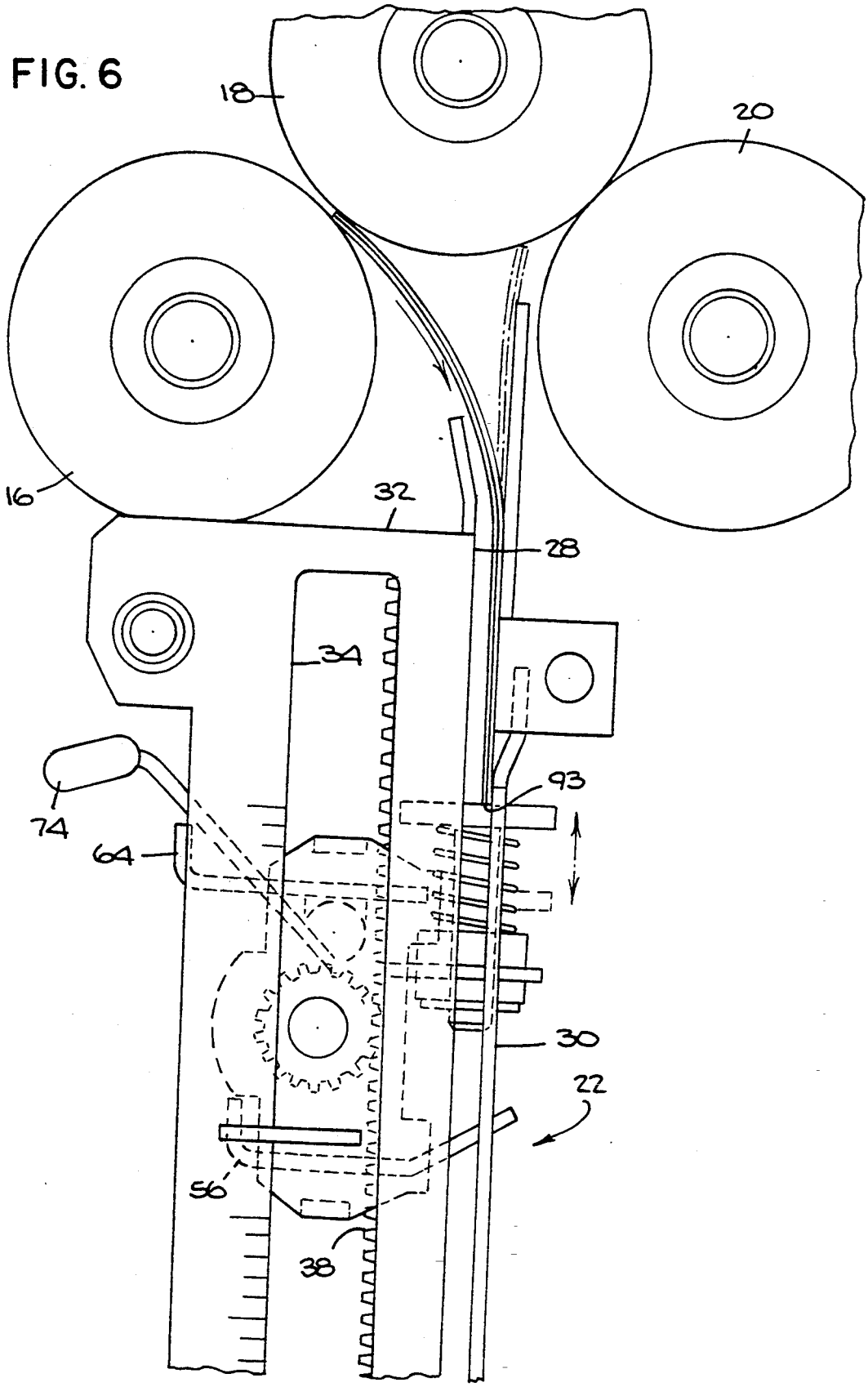
FIG. 6 is similar to FIG. 2 but shows the right buckle chute seen in FIG. 1.

The arrangement of the buckle chutes 22 and 26 seen in FIG. 1 is designed for the first buckle chute 22 to impart a single fold to a sheet of paper 12 and for the second buckle chute 26 to invert the once-folded paper 12 (see FIGS. 2 and 6). The sheet of paper 12 is fed from paper handling devices (not shown) located upstream of the folding apparatus 10 to the first feed roller 14 and the second feed roller 16 and then to the nip of the second feed roller 16 and the first folding roller 18, after which the paper 12 enters the first buckle chute 22. The paper then is stopped in the buckle chute 22 by the stopping tabs 60 and 62 and a buckle 91 (see FIG. 2) is formed in the paper 12. Continued feeding of the paper 12 by the rollers 16 and 18 results in the buckle 91 being fed into the nip of the folding 18 and 20 and the formation of a crease 93 in the buckle 91 (best seen in FIG. 6). The once-folded paper 12 now is fed crease first to the nip of the rollers 20 and 24 which feed the paper 12 into the second buckle chute 26, which is set up so that the plungers 86 and 88 can be deflected downward against the springs 90 and 92 to allow the once-folded paper 12 to totally enter the buckle chute 26 and clear the rollers 20 and 24. The plungers 86 and 88, by the action of the springs 90 and 92 respectively, then force the paper 12 upward and out of the buckle chute 26 crease trailing, into the nip of the rollers 24 and 27. The folded paper 12 then exits the rollers 24 and 27 for further processing and ultimately insertion into an envelope (not shown).

Although the arrangement of the plungers 86 and 88 for the two buckle chutes 22 and 26 is such that the first buckle chute 22 imparts a fold and the second buckle chute 26 inverts the paper, each buckle chute can have its plungers 86 and 88 set according to whatever folding and/or inverting action is required, including two folding modes, or a first inverting mode and a second folding mode. Because the instant invention obviates the need for an operator to remove the buckle chute in order to change to mode of the buckle chute, changes in the functioning made of the buckle chute are made operator-friendly.

It should be understood by those skilled in the art that various modifications may be made in the present invention without departing from the spirit and scope thereof, as described in the specification and defined in the appended claims.

What is claimed is:

1. A buckle chute for folding a sheet of paper, comprising:
   - a first plate having a longitudinally extending slot;
   - a second plate opposing said first plate and defining a paper path therewith;
   - a paper stopping tab extending through said longitudinally extending slot;
   - a paper inverting tab extending through said longitudinally extending slot and situated between said paper stopping tab and the opening at the chute, said inverting tab being pivotable between an operative position in said paper path and an inoperative position out of said paper path, wherein said inverting tab includes an aperture; and
   - a plunger seated in said aperture;
   - a lever operatively connected to said paper inverting tab and extending beyond the side edge of said first plate for pivoting said tab between said operative and inoperative positions.

2. The buckle chute according to claim 1, additionally comprising a compression spring to bias the plunger away from the paper inverting tab.

3. The buckle chute according to claim 2, additionally comprising means for adjusting said paper stopping tab and said paper inverting tab vertically along said first plate.

4. The buckle chute according to claim 3, wherein said adjusting means includes a rack mounted on said first plate and a carriage operatively connected to said paper stopping tab and said paper inverting tab, said carriage having a pinion gear to engage said rack.

* * * * *